United States Patent [19]

Lilley et al.

[11] 4,442,782

[45] Apr. 17, 1984

[54] FEED DISTRIBUTOR FOR MULTIPLE HEARTH FURNACE

[75] Inventors: Frank Lilley, Palo Alto, Calif.; Clarence S. Rankin, deceased, late of San Francisco, Calif., by Susan L. Rankin, executrix

[73] Assignee: Lurgi Corporation, River Edge, N.J.

[21] Appl. No.: 398,844

[22] Filed: Jul. 16, 1982

[51] Int. Cl.[3] ..... F23G 5/04

[52] U.S. Cl. ..... 110/225; 110/275; 110/277; 414/179

[58] Field of Search ..... 110/225, 275, 277; 414/179

[56] References Cited

U.S. PATENT DOCUMENTS

| | | | |
|---|---|---|---|
| 551,342 | 12/1895 | Wentworth . | |
| 876,567 | 1/1908 | Lee . | |
| 1,554,239 | 9/1925 | Sprague | 110/225 X |
| 2,030,734 | 2/1936 | Baird . | |
| 2,031,122 | 2/1936 | Mueller . | |
| 2,888,254 | 5/1959 | Hermann . | |
| 4,007,659 | 2/1977 | Frye . | |
| 4,261,268 | 4/1981 | Von Dreusche et al. | 110/225 X |

*Primary Examiner*—Edward G. Favors
*Attorney, Agent, or Firm*—Felfe & Lynch

[57] ABSTRACT

A multiple hearth furnace feed distributor including a conical table feeder attached to the center shaft of the furnace for rotation therewith, together with a stationary convolute plow fixed above the conical table feeder.

9 Claims, 7 Drawing Figures

FEED DISTRIBUTOR FOR MULTIPLE HEARTH FURNACE

This invention relates to furnace feeders and particularly a feed distributing system for multiple hearth furnaces.

In multiple hearth furnaces the usual manner of feeding material to be treated is by means of one or more individual gas sealed inlets located above the top hearth of the furnace with the feed material being directed onto the hearth immediately below the inlet to be rabbled across the hearth. In those instances where it is disadvantageous to have all of the feed material deposited at a single sector of the upper hearth, a plurality of such inlets are provided whereby the feed is somewhat distributed about the hearth. The plurality of feed inlets, however, requires a corresponding plurality of openings into the furnace with gas seals so as to isolate the atmosphere within the furnace and also to retain the heat within the furnace. This, of course, is relatively expensive and, in addition, makes feed quantity control more difficult.

It is, therefore, an object of this invention to provide an improved feed distributing system for multiple hearth furnaces.

It is a more particular object of this invention to provide a feed distributor for multiple hearth furnaces by which feed from a single inlet may be distributed about the upper hearth of the furnace prior to rabbling.

It is another object of this invention to provide a feed distributor as hereinabove defined together with alternative means by which a portion of the feed from the single inlet may be distributed about the uppermost hearth of the furnace while the remainder is distributed directly to a lower hearth, all prior to rabbling.

In accordance with the above objects there is provided a multiple hearth furnace feed distributor including a conical table feeder attached to the center shaft of the multiple hearth furnace for rotation therewith together with a convolute plow fixed above the conical table feeder. A feed inlet is located above the conical table feeder such that material deposited on the table immediately below the feed inlet is progressively urged toward the edge of the table feeder by means of the convolute plow. As the table is rotated under the stationary plow a curtain of feed material is thereby urged over the edge of the table throughout a substantial portion of its periphery.

Figure 1:
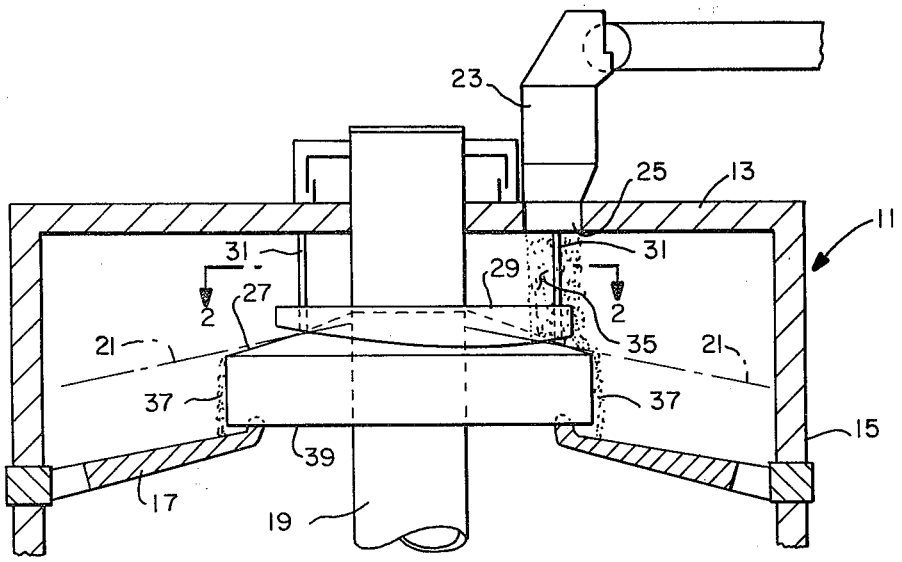
FIG. 1 is a partial elevational section view showing the upper hearth of the multiple hearth furnace including a feed distributor in accordance with the invention.
Figure 2:
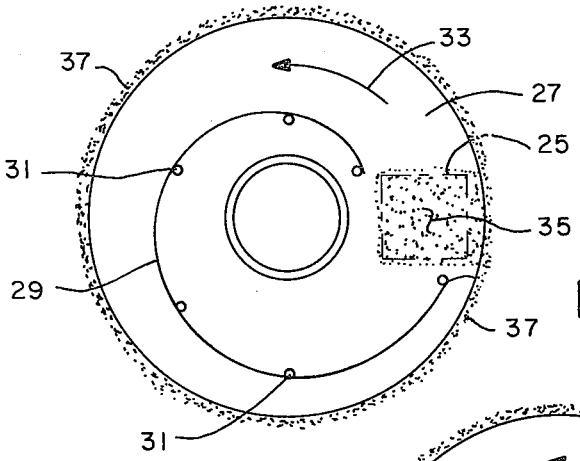
FIG. 2 is a sectional plan view of the feed distributor taken along the lines 2—2 of FIG. 1 and showing the areas of feed distribution.

Referring to FIGS. 1 and 2 there is shown a multiple hearth furnace 11 having a roof 13 and cylindrical side walls 15. The furnace, of course, includes a plurality of hearths, the upper hearth 17 being shown in FIG. 1. The furnace also includes a central shaft 19 which is rotated by the usual means and carries a number of rabble arms which, for clarity, are not fully shown but are indicated by their center lines 21.

A gas sealed feeder 23 of conventional type is mounted on the roof 13 of the furnace over an inlet opening 25. In accordance with the invention a furnace feed distributor is included in the space above the upper hearth 17 and includes a conical feed table 27 which is mounted on the central shaft 19 for rotation therewith. The feed table 27 has sufficient diameter that it extends below the inlet opening 25 and above the hearth 17. Thus material from the opening 25 is gravity fed onto the rotating conical table 27. A stationary convolute plow 29 is secured above the table 27 generally concentric therewith. Conveniently the plow 29 is held in position by a series of rods 31 extending from the roof of the furnace. The plow 29 is spaced sufficiently above the table 27 so as to provide for longitudinal thermal shaft expansion and also to prevent entrapment of feed stock between the stationary and rotating surfaces. As seen particularly in FIG. 2, the plow extends through an arc of about 315° and thus around a major portion of the table 27.

In operation, the shaft 19 and thus the table 27 are rotated in the direction of the arrow 33. Feed material is gravity fed through the gas seal above the opening 25 and thus dropped onto the table 27 in a stream 35. As the material is dropped onto the table the table, of course, rotates with the feed material being continually deposited thereon. As the table rotates, the feed material so deposited is moved radially outward under the influence of the stationary convolute plow 29. The feedstock is thereby urged over the perimeter of the table 27 in a circular curtain 37 to be uniformly distributed on the hearth 17. The feed stock curtain 37 may subject the material itself to increased thermal exposure as the hot gases pass from the lower hearths to the uppermost hearth 17. If desired, however, the conical table 27 may also include a skirt 39 extending downward from the outer perimeter of the conical section of the table 27 to a plane immediately above the hearth 17 so as to facilitate a gas seal between the hearth and the table similar to a lute cap.

While utilizing a feed distributor in accordance with the invention and particularly as shown in FIGS. 1 and 2, it is not necessary to split the feed stream into multiple tributaries for dispursion within the furnace and thus the difficulties of such splitting with particular feed stocks is avoided. Moreover, with the feed distributor, as shown in FIGS. 1 and 2, most multiple hearth furnace feed stock can be accommodated, even refuse derived fuels and other high volume low density materials which present serious handling problems in conventional multiple hearth feed distributing systems.

By providing a continuous feed in a circular curtain, as shown, material bridging resulting from static friction is thus avoided. In particular with feed stock such as refuse derived fuels, the distribution system in accordance with the invention prevents piles of feed from being bulldozed across the hearth rather than rabbled. Thus the system avoids the accumulation of material as experienced in usual feed systems employing single or multiple feed points. Moreover, by containing the feed distributor totally within the furnace building height requirements are reduced for the furnaces employing the invention as opposed to those including multiple feed points through the roof of the furnace. The system is also efficient in that the existing furnace drive provides all the power necessary for the distribution system. In addition, the conical table located below the plow provides self-relieving action of trapped materials between the rotating and stationary parts whether or not the skirt 39 is employed.

Figure 4:
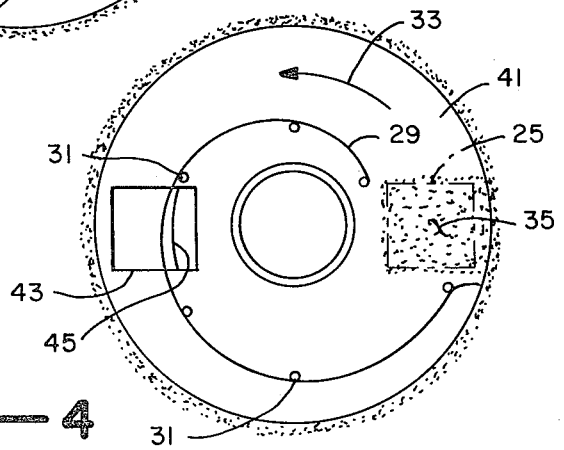
FIG. 4 is a sectional plan view of the feed distributor shown in FIG. 3 and taken along the lines 4—4 of FIG. 3.
Figure 3:
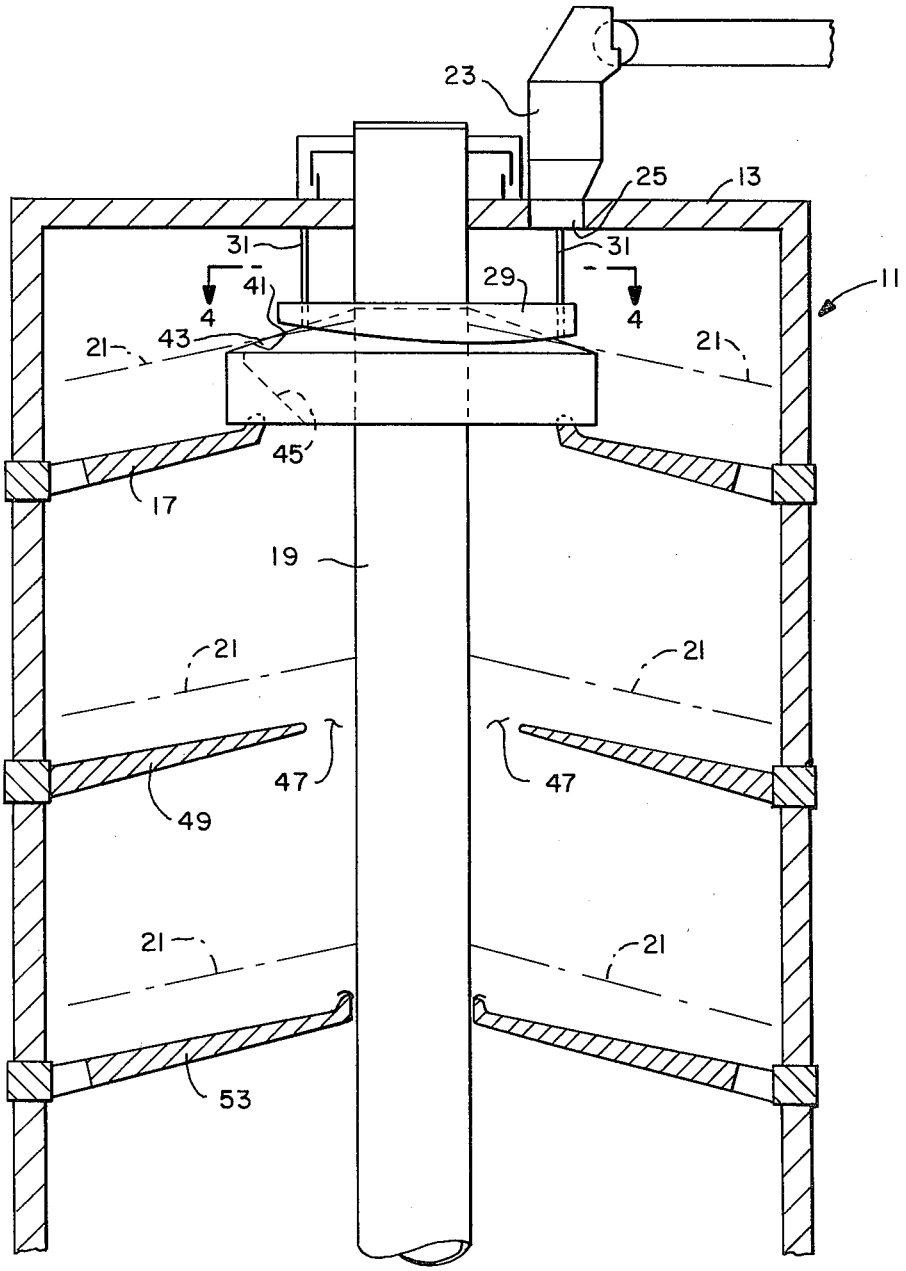
FIG. 3 is a partial elevational section view of a furnace having a feed distributing system in accordance with another embodiment of the invention wherein feed from the single feed chute is directed to a plurality of hearths.
Figure 5:
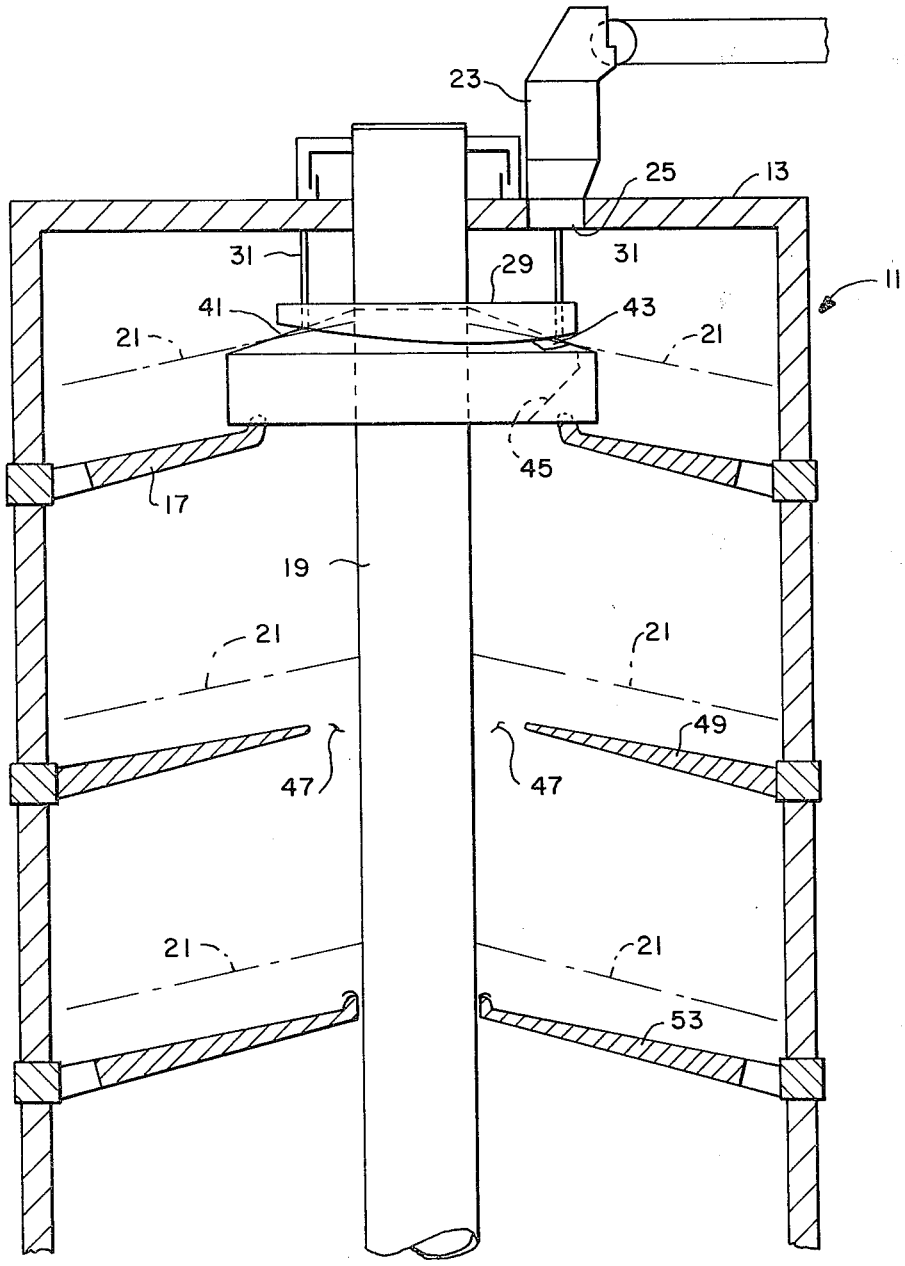
FIG. 5 is a view similar to FIG. 3 but showing the table feeder rotated 180° from the position shown in FIG. 3 and showing the dispursion of feed to the third hearth of the furnace as well as to the uppermost hearth.

Referring to FIGS. 3, 4 and 5 an alternative embodiment of the invention is shown wherein a portion of the feed from the inlet opening 25 is directed to a lower hearth than the uppermost hearth of the furnace. In this instance the convolute plow 29 overlies a conical table feeder 41 which includes an opening 43 and a chute 45 disposed below the opening 43 and downwardly slanted toward an opening 47 between the second hearth 49 and the central shaft 19. The chute 45 is arranged at an angle steeper than the angle of repose of the feed material so that the material relies only upon gravity for movement toward the opening 47.

Thus it is seen that with the embodiment shown in FIGS. 3, 4 and 5 when the solid conical surface of the table 41 passes beneath the opening 25, the operation of the system is identical to that shown in FIGS. 1 and 2. On the other hand, when the shaft 19 and table 41 rotate 180° from the position shown in FIGS. 3 and 4 to the position as shown in FIG. 5, the opening 43 lies in substantial vertical registry with the inlet opening 25. In this position material directed from the opening 25 passes directly through the opening 43 and is directed by the chute 45 to provide a feed material drop 51, as shown particularly in FIG. 5. The material in drop 51 bypasses the second hearth 49 and falls directly onto the hearth 53.

While the embodiment of FIGS. 3, 4 and 5 show a single opening 43, a plurality of openings may be employed such that each, in turn, is rotated into vertical registry with the inlet opening 25. In addition, the openings may be arranged in the table such as in the embodiment of the conical feed table shown in FIGS. 6 and 7. In the embodiment shown in FIGS. 6 and 7 the feed table 55 includes a plurality of openings 57, 59 and 61, below each of which is secured an inclined chute 63. The chutes 63, just as the chute 45 in the embodiment of FIG. 3, are disposed at an angle steeper than the angle of repose for the material to be handled in the furnace. It should be noted that in the embodiment of FIGS. 6 and 7 the openings 57, 59 and 61 are not rotated into vertical registry with the inlet opening 25. Rather, the table openings are positioned radially outward of the inlet opening 25 and at least a substantial portion of the conical surface of the table 55 is continuously below the inlet opening.

Figure 6:
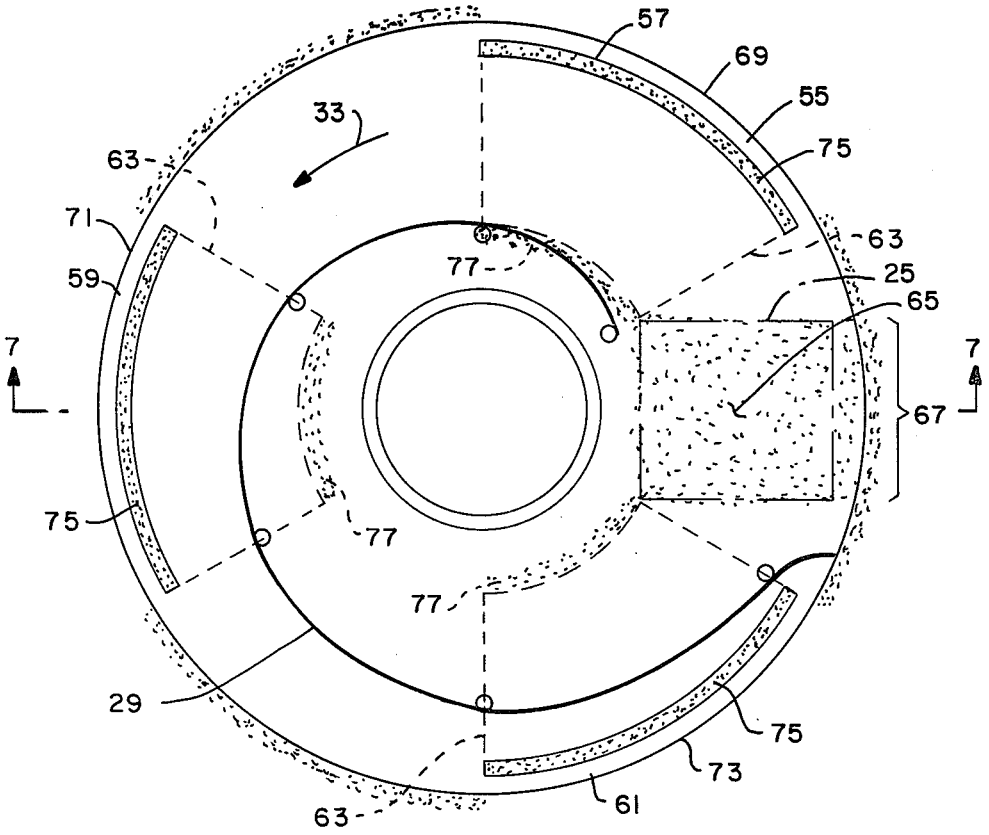
FIG. 6 is a sectional plan view similar to FIG. 4 but showing still another embodiment of the invention wherein feed material may be distributed uniformly to multiple hearths of the furnace.
Figure 7:
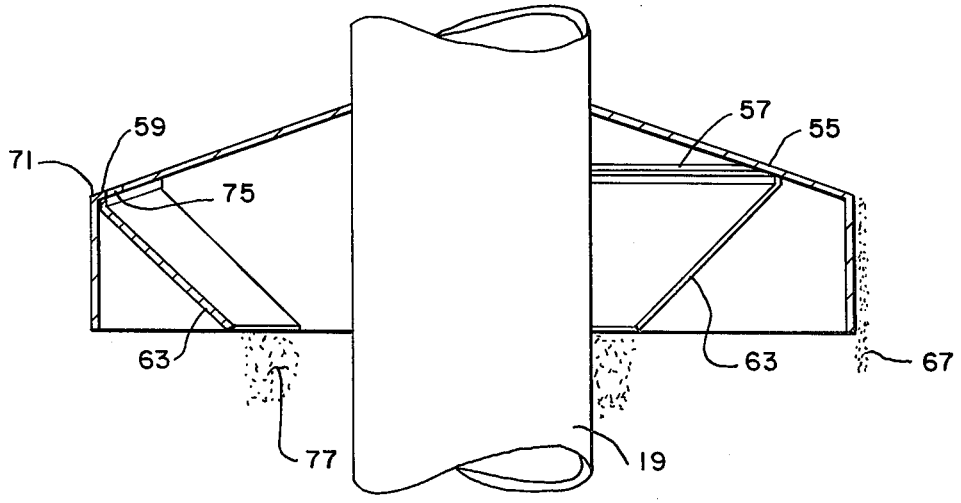
FIG. 7 is an enlarged sectional view taken along the line 7—7 of FIG. 6.

In the operation of the embodiment shown in FIGS. 6 and 7 feed from the opening 25 is deposited on the conical table in an area 65 immediately therebelow. Because of the inclination of the conical table and the inertia of the dropping materials, a portion of the feed material falls off the lip of the table to provide the portion of a feed curtain as shown in the area 67. As in the above described embodiments, upon the rotation of the table in the direction of the arrow 33, feed from the opening 25 is deposited uniformly about the table 55. Moreover, the plow 29 serves the same function of pushing the material radially outward toward the edge of the table.

As shown in FIGS. 6 and 7, however, before the material reaches the edge of the table in certain sectors it reaches one of the openings 57, 59 or 61 through which it may fall. The respective openings 57, 59 and 61 should, of course, be large enough to freely pass any of the material of the feed.

Rather than the provision of openings 57, 59 and 61, the corresponding sectors of the conical table may be provided with a smaller radius than the remainder of the table. With such a construction, the portions 69, 71 and 73 of the table lying beyond their respective openings is thus eliminated and bridging of the feed over openings 57, 59 and 61 is avoided regardless of the feed material. In either construction, an edge 75 is provided over which the feed material may fall to be received and directed by a chute 63 to a lower hearth in a stream 77 rather than to the uppermost hearth.

Moreover, it should be recognized that even with a table construction as shown in FIGS. 1 and 2, passage of material to a lower hearth may be accomplished merely by the provision of chutes, such as the chutes 63 and 45 described above, but extending beyond the periphery of the table such that a portion of the curtain 37 of feed can be received and redirected by the chute.

The simultaneous feeding of multiple hearths in multiple hearth furnaces permits the distribution within the furnace rather than externally as in existing designs. The feed stock enters the upper hearth through the single opening in the roof and there is continuous gravity loading onto or through the rotating conical table. The dual hearth loading reduces the bed depth in the uppermost hearths thereby providing improved feed stock rabbling and conveyance through the furnace, subjecting the reduced bed to increased feed stock hot gas contact with consequential superior thermal processing. The bed reduction also minimizes the bridging potential in the out hearth drop holes. Moreover, free fall to a lower hearth exposes the feed stock to the counterflow hot gas stream resulting in partial drying of the contained moisture which, in conjunction with the hot char/feed stock mixing, increases the rate of thermal degradation and furnace efficiency.

What is claimed is:

1. A material feed distributor for use in a furnace having at least one hearth, a central vertical shaft rotatable within the furnace and a roof over said hearth defining a material inlet, said feed distributor comprising a conical table feeder attached to said central vertical shaft for rotation therewith, said conical table feeder including a conical surface defining at least one opening therethrough, said opening being positioned radially outward from said central vertical shaft substantially the same distance as is said material inlet whereby, upon rotation of said table with said shaft, said opening is periodically in vertical alignment with said material inlet; a convolute plow fixed to said furnace at a position above said table feeder, said convolute plow being generally concentric within said table feeder and extending around the major portion thereof.

2. A material feed distributor as defined in claim 1 wherein said conical table feeder further includes a chute disposed below said opening and downwardly inclined radially inward.

3. A material feed distributor as defined in claim 1 wherein said conical table feeder includes a conical surface defining at least one opening therethrough, said opening being positioned radially outward from said central vertical shaft by a distance greater than the distance by which said material inlet is positioned whereby upon rotation of said table with said shaft, the surface of said conical table feeder is continuously positioned below said material inlet.

4. A material feed distributor as defined in claim 3 wherein said conical table feeder further includes a chute disposed below said opening and downwardly inclined radially inward.

5. A material feed distributor as defined in claim 1 wherein said conical table feeder includes a conical surface having an outer peripheral edge portion of maximum diameter and a second edge portion of a lesser diameter, said outer peripheral edge portion and said second edge portion being disposed in adjacent sectors of said conical surface, and said second edge portion being positioned outward from said central vertical shaft by a distance greater than the distance by which said material inlet is positioned, whereby, upon rotation of said table with said shaft, the surface of said conical table feeder is continuously positioned below said material inlet.

6. A material feed distributor as defined in claim 5 wherein said conical table feeder further includes a chute disposed below said second edge portion and downwardly inclined radially inward.

7. A material feed distributor as defined in claim 1 wherein said conical table feeder includes a conical surface defining an edge positioned outward from said central vertical shaft by a distance greater than the distance by which said material inlet is positioned and a chute disposed below said edge and downwardly inclined.

8. A material feed distributor as defined in claim 7 wherein said chute is downwardly inclined radially inward.

9. A material feed distributor as defined in either of claims 1, 2, 3, 4, 5, 6, 7 or 8 wherein said conical table feeder comprises a conical portion attached to said central vertical shaft and a skirt portion extending downward from the outer perimeter of the conical portion.

* * * * *